US005310973A

United States Patent [19]

Lee

[11] Patent Number: 5,310,973

[45] Date of Patent: * May 10, 1994

[54] STRUCTURE OF KEY SWITCH

[75] Inventor: Michael Lee, Taipei, Taiwan

[73] Assignee: Silitek Corporation, Taipei, Taiwan

[ * ] Notice: The portion of the term of this patent subsequent to Apr. 6, 2010 has been disclaimed.

[21] Appl. No.: 772,795

[22] Filed: Oct. 8, 1991

[51] Int. Cl.[5] ..... H01H 13/70

[52] U.S. Cl. ..... 200/345; 200/513; 200/515; 200/534

[58] Field of Search ..... 200/345, 513, 515, 534, 200/341, 342, 292, 306, 517, 275, 83 A, 83 R, 83 B, 834, 835, 237; 4/255.11, 255.12

[56] References Cited

U.S. PATENT DOCUMENTS

| | | | |
|---|---|---|---|
| 1,154,055 | 9/1915 | Reeves | 4/255.12 |
| 2,203,185 | 6/1970 | Walus | 4/255.11 |
| 3,829,646 | 8/1974 | Lorteije et al. | 200/513 |
| 4,418,257 | 11/1983 | Muller et al. | 200/517 |
| 4,453,061 | 6/1984 | Tamura | 200/534 |

OTHER PUBLICATIONS

Maxi-Switch Co. Feb. 24, 1982, (*Electronics* Magazine).

*Primary Examiner*—Henry J. Recla
*Assistant Examiner*—David J. Walczak
*Attorney, Agent, or Firm*—Browdy and Neimark

[57] ABSTRACT

A key switch includes a switching member supported on a resilient member and connected to a key cap and driven by it to slide in a locating member. The switching member has two opposite, curved side plates caused to slide in the locating member along two opposite sliding ways. The elastic member has a plurality of small raised portions supported on the PC board, a plurality of spaced ribs on the inner wall surface to reinforce the structure and the elastic resilient property thereof, and a plurality of notches between the raised portions for exhaust of air squeezed by the circular flange of said switching member.

1 Claim, 2 Drawing Sheets

STRUCTURE OF KEY SWITCH

BACKGROUND OF THE INVENTION

The present invention relates to a key switch which is easy to assemble, which is smooth in operation, and which does not produce noise during the operation.

Various mechanical key switches have been known. These known structures of key switches are generally expensive to manufacture and complicated to assemble. Further, they produce loud noise during the operation. The present invention has been accomplished to eliminate these disadvantages.

According to the present invention, there is provided a key switch which is generally comprised of a switching member supported on a resilient member and connected to a key cap and driven by the key cap to slide in a locating member. The switching member has two opposite, curved side plates caused to slide in the locating member along the two opposite sliding ways in the locating member. The elastic member has a plurality of small raised portions supported on the PC board of a keyboard, a plurality of spaced ribs on the inner wall surface thereof to reinforce its structure and elastic resilient property, and a plurality of notches between the raised portions for exhaust of squeezed air so as to eliminate possible noise.

BRIEF DESCRIPTION OF THE DRAWINGS

FIG. 4 is a sectional elevation thereof when it is switched on.

DETAILED DESCRIPTION OF THE PREFERRED EMBODIMENT

Figure 1:
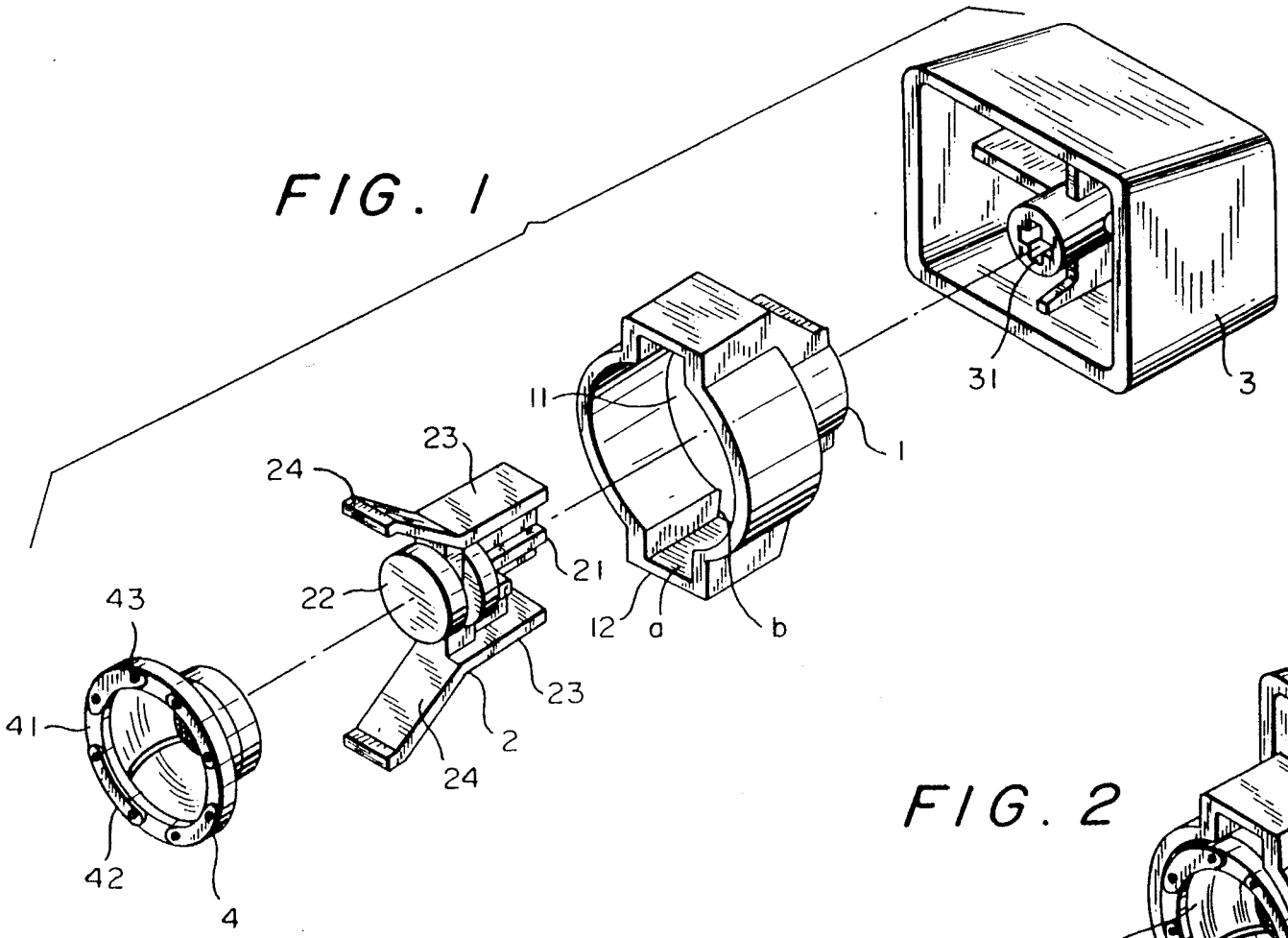
FIG. 1 is an exploded perspective view of the preferred embodiment of the key switch of the present invention.
Figure 2:
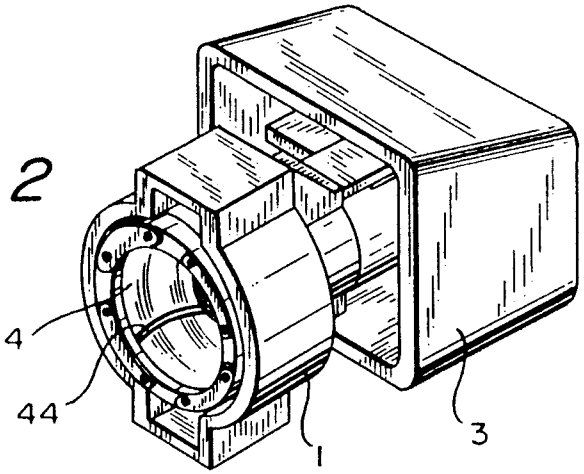
FIG. 2 is an assembly view thereof.
Figure 3:
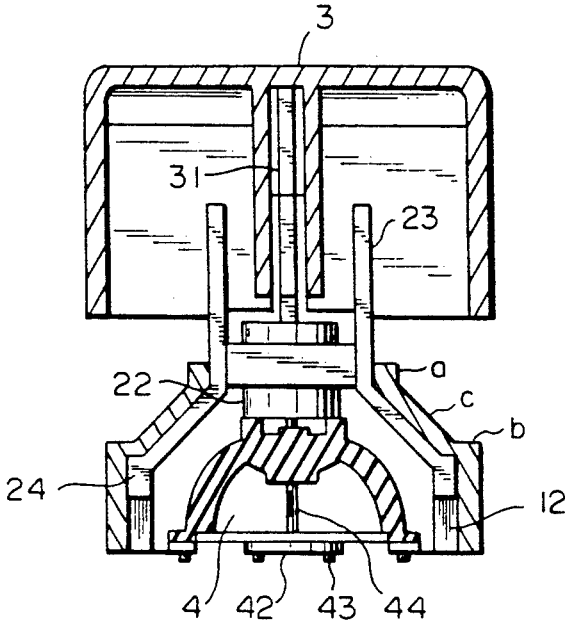
FIG. 3 is a sectional elevation thereof when it is switched off.
Figure 4:
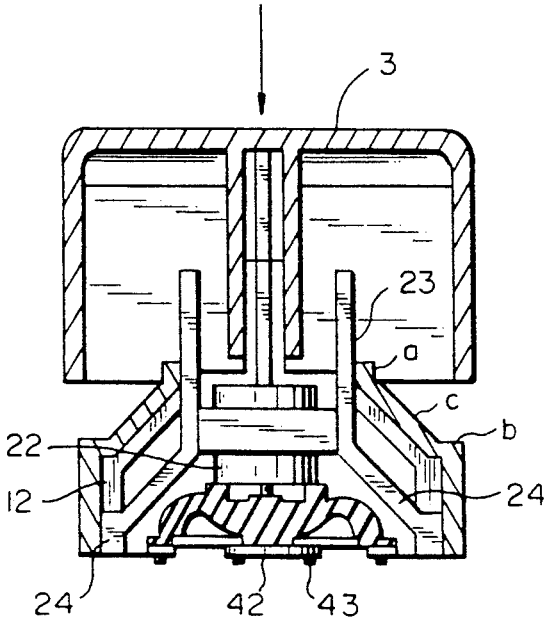

Referring to the annexed drawings in detail, therein illustrated is the preferred embodiment of the key switch of the present invention which is generally comprised of a locating member 1, a switching member 2, a key cap 3 and an electrically conductive elastic member 4, the center of which is adapted to electrically contact a PC board when the button is pressed to thereby complete an electrical circuit on the board.

The locating member 1 is comprised of a substantially ring-shaped body defining therein two opposite sliding ways 12 at two opposite locations within the central opening 11 thereof. Each of sliding ways 12 is formed of a lower surface portion "a", an upper surface portion "b" and a sloping surface portion "c" therebetween. The switching member 2 comprises a cross rib 21 and a circular flange 22 longitudinally aligned at the middle and two opposite side plates 23 attached to the cross rib 21 at two opposite sides. Each of side plates 23 has an extension 24 obliquely extending downwardly outwards. The key cap 3 has a cross slot 31 on the bottom at the center. The elastic member 4 comprises a plurality of notches 41 on the ring-shaped bottom edge thereof defining therebetween a plurality of raised edges 42 each of which has a plurality of raised portions 43, and a plurality of spaced ribs 44 on the inner wall surface thereof.

The assembly process of the present invention is outlined hereinafter. Insert the two slide plates 23 of the switching member 2 through the two sliding ways 12 of the locating member 1 into the central opening 11 thereof permitting the two extensions 24 to be respectively attached to the two opposite lower surface portions "a" and the two opposite sloping surface portions "c". Then, attach the key cap 3 to the switching member 2 permitting the cross rib 21 of the switching member 2 to be firmly engaged in the cross slot 31 on the key cap 3, as a result of which the key cap 3 and the switching member 2 are movably connected in the locating member 1. After assembly, the circular flange 22 is resiliently supported on the elastic member 4 which is fastened in a PC board of a keyboard (not shown).

When the key cap 3 is pressed down, the switching member 2 is moved downwards by means of the sliding of the two side plates 23 thereof in the two sliding ways 12 in the locating member 1. By means of the guide of the two sliding ways 12, the switching member 2 is caused to move smoothly up and down in the locating member 1 in response, respectively, to the restoring force provided by member 4 and the downward force exerted by key cap 3 on the switching member when the button is pushed. When the elastic member 4 is squeezed by the switching member 2, squeezing air is exhausted through the notches 41 on the bottom edge of the elastic member 4, and therefore, less noise is produced. Because the elastic member 4 is supported on the PC board by the raised portions 43, the contact area between the elastic member 4 and the PC board is greatly reduced, and therefore, satisfactory contact is achieved and the service life of the key switch is greatly extended. Further, the ribs 44 on the inner wall surface of the elastic member 4 make the structure of the elastic member 4 stronger and more easily returned to its original shape. The key switch described herein has been tested to be capable of being structured more than fifty million times.

What is claimed is:

1. A key switch, comprising:

a locating member including a substantially ring-shaped body defining therein two opposite sliding ways within a central opening thereof, the central opening having two opposite locations and the opposite sliding ways being located at the two opposite locations, said sliding ways each being formed of a lower surface portion, and upper surface portion and a sloping surface portion therebetween;

a switching member inserted in said central opening of said locating member, said switching member comprising a cross rib and a circular flange longitudinally aligned at a middle portion of the switching member between two opposite sides, and two opposite side plates attached to said cross rib at the two opposite sides, said side plates being moved to slide in said two sliding ways, each of said side plates having an extension obliquely extending downwards and outwards and arranged to engage said lower and sloping surface portions of said sliding ways;

a key cap movably connected to said switching member to drive it to slide in said locating member, said key cap having a cross slot on a bottom at a center into which said cross rib is engaged;

an elastic member adapted to support said switching member on a PC board in a keyboard, said elastic member having a ring-shaped bottom, said ring-shaped bottom having a plurality of notches defining therein a plurality of raised edges, each of said edges having a plurality of raised portions adapted to be supported on said PC board, wherein said elastic member is electrically conductive and adapted to contact said PC board and close an electrical circuit thereon when said button is pressed, and wherein said elastic member further comprises a plurality of spaced ribs on an inner wall surface thereof to reinforce the structure of the circular flange and the elastic resilient properties thereof.

* * * * *